United States Patent [19]

Rahmstorf

[11] 4,044,498

[45] Aug. 30, 1977

[54] TOY ANIMAL FIGURES WITH INTERCHANGEABLE SADDLE AND CENTER BODY PART

[75] Inventor: Dietmar Rahmstorf, Nurnberg, Germany

[73] Assignee: Messrs. BIG Spielwarenfabrik Dipl.-Ing. Ernst A. Bettag, Furth, Bayern, Germany

[21] Appl. No.: 709,287

[22] Filed: July 28, 1976

[30] Foreign Application Priority Data

Aug. 2, 1975 Germany ..... 7524554[U]

[51] Int. Cl.[2] ..... A63H 3/16

[52] U.S. Cl. ..... 46/116; 46/22; 46/127

[58] Field of Search ..... 46/162, 116, 22, 17, 46/127

[56] References Cited

U.S. PATENT DOCUMENTS

| | | | |
|---|---|---|---|
| 168,819 | 10/1875 | White | 46/127 |
| 2,308,524 | 1/1943 | Longnecker | 46/17 |
| 2,919,516 | 1/1960 | Schaefer | 46/22 |

FOREIGN PATENT DOCUMENTS

| | | | |
|---|---|---|---|
| 1,076,612 | 4/1954 | France | 46/22 |
| 1,112,903 | 11/1955 | France | 46/22 |
| 605,609 | 7/1948 | United Kingdom | 46/162 |

*Primary Examiner*—F. Barry Shay

[57] ABSTRACT

The invention concerns toy animal figures with four legs and a rigid, shaped body. In order to achieve as natural an appearance of such figures as possible, also to enable a toy human figure with a realistically small leg spacing to be mounted on the animal figure, preferably with a saddle, the middle of the animal body is formed by a narrow web coverable either by a centerpiece completing the body or by a saddle. When the centerpiece is placed in position no "rider" can be mounted thereon. When, however, a saddle is mounted, in place of the centerpiece, a figure with small leg spacing can "ride" on the animal.

6 Claims, 5 Drawing Figures

TOY ANIMAL FIGURES WITH INTERCHANGEABLE SADDLE AND CENTER BODY PART

BACKGROUND OF THE INVENTION

1. FIELD OF THE INVENTION:

The invention concerns toy animal figures with four legs, particularly horses or the like, which have a device for accommodating a saddle on a body of rigid shape.

2. DESCRIPTION OF THE PRIOR ART

For some time now, toy figure sets have been commercially available and generally consist of at least one toy figure in the form of a replica of a human being, and sundry accessories for the or each such figure. In order to ensure that the figure(s) of the set can stand well, the legs thereof must be as rigid as possible, in addition, in order to achieve an appearance which corresponds as much as possible to that of an actual person, it must be attempted to arrange the legs at a small spacing from each other.

Attempts have been made to develop these known sets by associating the toy figures with representations of animals on which the figures can then "ride". In this context, it is, however, necessary that the legs of the (human) figures and the bodies of the animals should be so constructed that, when "riding", the legs should without difficulty be able to engage around the middle of the body, however, if one makes the anifmal figure relatively true to nature, i.e. with a proportionate body thickness, then mounting a human figure on it with the naturalistically small leg spacing is not possible.

It would be conceivable to provide the figures with bendable legs so as to enable them to "ride". In this case, however, difficulties arise in placing the figures into an acceptable standing position because of the need to straighten the legs for this purpose. Bending the legs to bring them to an appropriate leg spacing around the thickness of the body of the animal cannot be considered for visual reasons.

In order nevertheless to enable toy human figures with legs running in parallel and at a relatively small spacing from each other to ride on animal figures, it is also already known so to construct the animal figure that the body thereof is somewhat constricted or tapered in its middle region, wherein the constriction is gradual from the ends of the body. In this case it is possible to mount human figures with small leg spacing on the animal figures in order to "ride", even when a saddle is laid on the body. However, this known solution has the disadvantage that, because of the unnatural tapering or constriction of the middle of the body, the appearance of such toy figures differs from the natural to such an extent that a playing child is disturbed or bothered by it.

SUMMARY OF THE PRESENT INVENTION

Accordingly, an aim of the invention is to provide a toy animal figure, particularly a horse, a donkey, a camel or the like, which corresponds to the natural as far as possible when no rider is mounted thereon, but which nevertheless enables a human figure with small leg spacing to ride it after mounting a saddle on the animal, but preferably even without the saddle.

To achieve this aim it is proposed according to the invention to provide a toy animal figure of the above-mentioned type, wherein the middle of the body is formed by a vertical, narrow web extending in the longitudinal direction of the body, on which web is mountable, either a body centerpiece matched to the body parts adjoining the web, or a saddle. Advantageously, in order to hold the body centerpiece or the saddle fast in position, these members are snappable on to the web.

Thus when the toy animal figure according to the invention is to be used only for decoration purposes or the like or e.g. only as a draught animal, i.e. is not destined to carry a rider, a body centerpiece is mounted on the web to form the middle of the body, which centerpiece is so constructed that it corresponds to the natural body shape of the animal in the region of the middle of its body. The toy animal figure then corresponds to a very considerable extent to the natural appearance if one ignores the slight joint lines between the centerpiece of the body and the adjacent body parts.

If, the other hand, it is desired to have a small figure riding on the animal figure according to the invention, then the body centerpiece is removed and in its place a saddle is mounted which, as regards its outer dimensions, i.e. in particular with regard to the spacing of its side surfaces, can be matched to the leg spacing of the figure, since at its interior it only needs to accommodate the web forming the middle of the body. Because of the reduction of the transverse dimensions of the body in the region of the saddle, vertical grooves are, in effect, formed on both sides of the body to accommodate the legs of the "rider". This has the additional and noteworthy advantage that the legs of the "rider" are well guided in the vertical grooves and as a consequence the rider sits fast on the animal figure.

Advantageously, at least the body centerpiece, but expediently also the saddle, is symmetrically constructed about its transverse central plane, because then the playing child does not need to watch how he mounts the body centerpiece in the complementary cut-out of the body disposed about the web.

Advantageously, the saddle has a middle part which is somewhat U-shaped, in cross-section and which overlaps the web from above and has shanks engaging the side surfaces of the web, the spacing of the outer surfaces of the shanks (of the saddle) being considerably smaller than the thickness of the body at the body parts directly adjoining the web.

In such a construction of the saddle, it is expedient to provide a saddle with side plates which cover the edge surfaces directed towards the web of the body parts adjoining the web, because by such a construction the playing child scarcely notices the circumstance that in the region of the saddle the body is unnaturally constructed and consequently the natural appearance is scarcely harmfully influenced.

Finally, it is within the framework of the invention to provide the said plate of the saddle with beaded edges or collars which at least somewhat overlap the body parts adjoining the web, at least on the upper surface.

DESCRIPTION OF THE PREFERRED EMBODIMENTS

Figure 1:
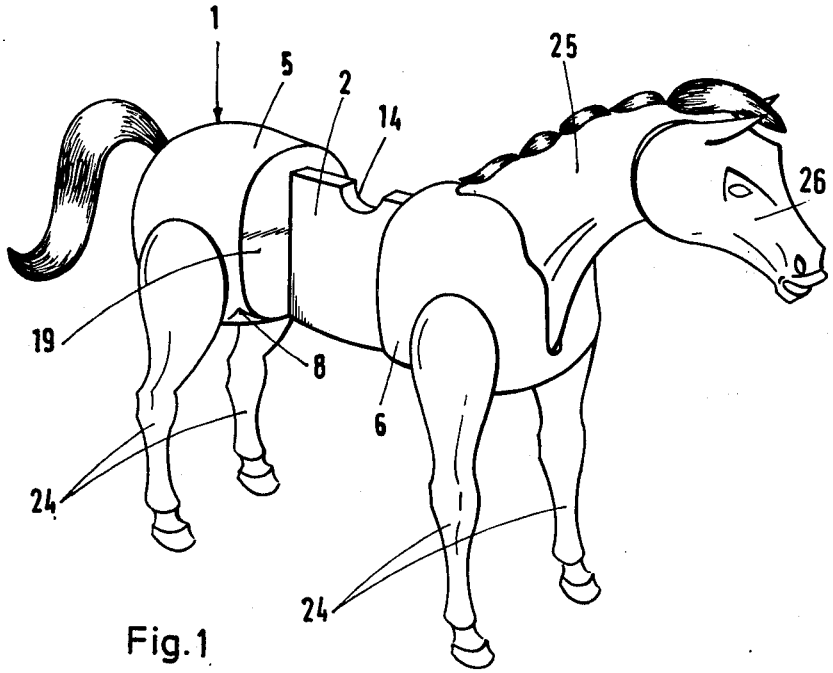
FIG. 1 is a perspective view of a preferred embodiment, of the invention, in the form of a toy horse figure, with its central body portion removed.

As may be seen clearly from FIG. 1, the horse has at the middle of its body 1 a narrow web 2 running along the longitudinal direction of the body 1. The width of the web 2 (transversely of the horse) is, as can be seen most clearly from FIG. 1, considerably narrower than the actual width of the body at the corresponding position.

Figure 2:
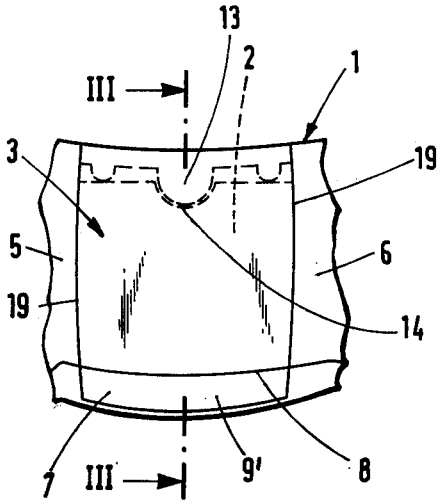
FIG. 2 is a side view of the middle region of the horse of FIG. 1, with the body centerpiece mounted thereon.
Figure 3:
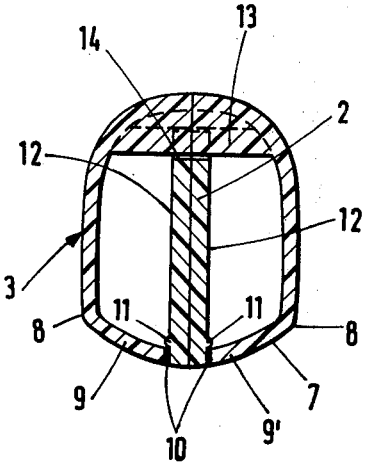
FIG. 3 is a section taken on the line III-III in FIG. 2.
Figure 4:
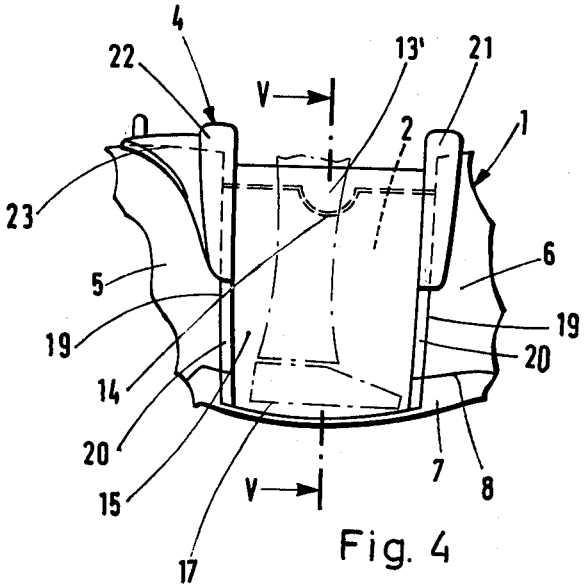
FIG. 4 is a side view of the middle of the horse, similar to FIG. 2, but with a saddle mounted thereon.
Figure 5:
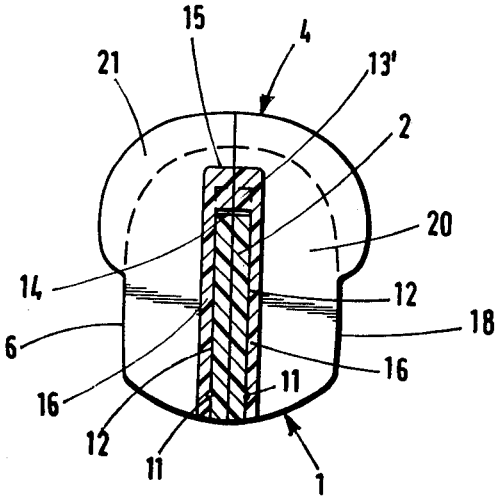
FIG. 5 is a section along the line V-V in FIG. 4.

In use of the animal the web 2 is, either covered by a body centerpiece 3, as shown in FIG. 2 and 3, or, as shown in FIGS. 4 and 5, is covered by a saddle 4.

As shown by a comparison of FIGS. 1 and 3, the body centerpiece 3 has a contour matching the adjoining parts 5 and 6 of the body 1 of the animal. The contour is somewhat oval-shaped (FIG. 3), and of course at the transition to the underside 7 there are light edges 8. Starting from these edges 8, the centerpiece 3 has two shanks 9, 9', the free ends 10 of which engage the web 2 laterally, as can be seen clearly from FIG. 3.

The free ends 10 in the use position engage behind bosses or lugs 11 on the side surfaces 12 of the web 2 (FIG. 3), whereby the body middle piece 3 is locked or snapped into its use position appropriately relative to the longitudinal web 2 and the body 1 of the animal.

The centerpiece 3 is otherwise constructed from two symmetrical halves which are connected with each other at the top around thickened portion 13, e.g. with the aid of the mortise and tenon join. To accommodate the thickened portion 13 the web 2 has a recess 14 at its upper edge.

The saddle 4, the construction of which can be seen from FIGS. 4 and 5, preferably also consists of two mutually symmetrical halves. Here also the connection between the two halves is provided in the region of a thickened portion 13'.

The saddle 4 includes a middle portion 15 which is somewhat U-shaped in cross-section and which, as can be seen from FIG. 5, overlaps the web 2 from above. Both shanks 16 of the U-shaped middle part 15 of the saddle 4 engage the side surfaces 12 of the web in the use position. Complementary recesses of the shanks 16 of the middle part 15 engage with or snap into the lugs 11 of the web 2 whereby the saddle 4 is locked in the use position.

As a result of the small thickness of the web 2 and the smaller wall thickness of the middle part 15 of the saddle, the spacing of the outer surfaces of the shanks 16 of the saddle middle portion 15 is considerably smaller than the thickness of the body 1 in the body portions 5 and 6 directly adjacent (in front and behind) to the web, as can be seen clearly from FIG. 5.

Consequently, it becomes possible to mount a figure with relatively small leg spacing on the saddle 4, as can be seen by the legs 17 of a suitable toy figure, shown in chain lines in FIG. 4. These legs 17 are disosed in the region directly adajcent to the shanks 16 of the middle piece 15 of the saddle, i.e. within the outer surfaces 18 of the body 1.

In order to match the saddle 4 well to the recess formed by the web 2 in the body 1, the saddle 4 has, both at the front and at the rear, end plates 20 spaced on both sides from the middle part and covering the edge surfaces 19 of the body parts 5, 6 adjacent to the web 2. These plates 20 carry in addition, edge collars or beads 21, 22 which somewhat overlap the upper portion of the body parts 5, 6 adjacent to the web 2. The collars or beads 21, 22 are similar to the bolsters provided normally on a saddle. The front edge collar 21 is relatively short, while the rear collar 22 has an extension 23.

In play the child mounts the saddle 4 on the web 2 when he wants to place a rider on the horse. I would of course also be conceivable to mount a rider without mounting the saddle 4 on the web 2 in which case the rider rides on an unsaddled animal. On the other hand, is the horse, or another similarly built toy animal such as a donkey or a camel etc. is to be used without a rider, i.e. is to be used as a draught animal or placed on a pasture land, then the saddle 4 is pulled off upwardly and in its place the body centerpiece 3 is mounted from above, as shown in FIGS. 2 and 3. The body 1 of the animal is then completed by the centrepiece 3 so that the animal appears to a very considerable extent true to nature.

A characteristic of the illustrated model of a horse is that the four legs 24 as well as the neck 25 are each hingedly connected with the body 1. In addition, the head 26 is hingedly connected with the neck 25, with each individual hinge or pivot permitting vertical pivotal movement to occur. Due to this construction, it is possible to bring the animal figures to a plurality of positions so as significantly to increase the incentive to play.

I claim:

1. A quadruped toy animal figure of the type used to mount a rider comprising a rigid body capable of carrying a saddle, wherein the improvement consists in that the middle of the body is constructed from a narrow web extending in the longitudinal direction of the body between front and rear parts of generally naturally appearing proportion; a body centerpiece and a saddle each formed with respective means enabling either one of them to be selectably securely mounted on said web; said centerpiece being shaped at its outer surface to blend with the contour of the parts of the said body adjacent to the said web.

2. A toy animal figure according to claim 1 in which the said means for mounting the centerpiece and the saddle are resilient snap engagement means.

3. A toy animal figure according to claim 1 in which at least one of the said centerpiece and the said saddle is symmetrically formed about its transverse central plane.

4. A toy animal figure according to claim 1 in which the saddle is somewhat U-shaped in crossction at its middle part which overlaps the web from above, the shanks of the U engaging the side surfaces of the web, the distance between the outer surfaces of the shanks being considerably smaller than the thickness of the body at the said body parts directly adjoining the web.

5. A toy animal figure according to claim 4 in which there are end plates on the saddle for covering the edge surfaces of the said body parts adjacent to the web which edge surfaces are directed towards the web.

6. A toy animal figure according to claim 5 in which edge beads are provided on the end plates of the saddle, which beads somewhat overlap, at least at the top, the said body parts adjacent to the web.

* * * * *